US006719418B2

(12) United States Patent
Chou et al.

(10) Patent No.: US 6,719,418 B2
(45) Date of Patent: Apr. 13, 2004

(54) UNDERPRESSURE REGULATING MECHANISM FOR INKJET PENS

(75) Inventors: Ching-Yu Chou, Taipei (TW); Wen-Chung Chen, Hsinchu (TW); Chien-Ming Lin, Taipei (TW); Chuang-Hsien Chiu, Hsinchu (TW)

(73) Assignee: Nanodynamics Inc., Hsinchu Hsien (TW)

( * ) Notice: Subject to any disclaimer, the term of this patent is extended or adjusted under 35 U.S.C. 154(b) by 78 days.

(21) Appl. No.: 10/201,905

(22) Filed: Jul. 25, 2002

(65) Prior Publication Data

US 2003/0020794 A1 Jan. 30, 2003

(30) Foreign Application Priority Data

Jul. 27, 2001 (TW) ..... 090118434
Jul. 27, 2001 (TW) ..... 090118437

(51) Int. Cl.[7] ..... B41J 2/175
(52) U.S. Cl. ..... 347/87
(58) Field of Search ..... 347/87, 86, 85, 347/23, 84, 19, 93, 97, 94, 6, 7, 89, 30, 35; 222/105, 386.5, 95

(56) References Cited

U.S. PATENT DOCUMENTS

| | | | | |
|---|---|---|---|---|
| 4,992,802 A | | 2/1991 | Dion et al. | 347/87 |
| 5,039,999 A | * | 8/1991 | Winslow et al. | 347/87 |
| 5,040,002 A | | 8/1991 | Pollacek et al. | 347/87 |
| 5,409,134 A | | 4/1995 | Cowger et al. | 221/1 |
| 5,505,339 A | | 4/1996 | Cowger et al. | 222/105 |
| 5,975,689 A | * | 11/1999 | Pawlowski, Jr. et al. | 347/85 |
| 6,164,742 A | * | 12/2000 | Hauck | 347/6 |

* cited by examiner

*Primary Examiner*—Raquel Yvette Gordon
*Assistant Examiner*—Charles W. Stewart, Jr.

(57) ABSTRACT

An inkjet pen including an ink reservoir for storing ink and providing ink for jetting. A port, located on top of the ink reservoir, fluid-communicated with the ambient air, is used for adjusting the air pressure inside the reservoir. A valve, operated by a spring or a resilient element, normally seals the port, while occasionally opening the port to introduce air into the reservoir when the ink level is low and the underpressure rises. In other embodiments, an elastic bag is included in the reservoir that has an opening communicated with the ambient air through a second port formed on top of the reservoir. The elastic bag expands in response to the increasing underpressure generated in the reservoir when ink is being used. The bag expansion actuates the opening of the valve so as to regulate the underpressure.

20 Claims, 17 Drawing Sheets

UNDERPRESSURE REGULATING MECHANISM FOR INKJET PENS

BACKGROUND OF THE INVENTION

1. Field of the Invention

The invention relates to a mechanism for regulating the ink pressure within an ink reservoir of an inkjet pen. The mechanism automatically regulates the underpressure inside the inkjet pen to prevent the ink from leaking.

2. Related Art

Common inkjet printers apply ink pens that include ink reservoirs and print heads. The print head controls ink drops jetting from the ink reservoir. Two common methods for inkjet control are the thermal bubble system and the piezoelectric system. Although conventional print heads are effective for jetting ink drops from pen reservoirs, they need extra mechanisms for preventing ink from leaking out of the print heads when the print heads are inactive. These mechanisms generally provide slight underpressure at the print heads to prevent ink leakage from the pens whenever the print heads are inactive. The term "underpressure" used herein means a partial vacuum (less pressure than the ambient air) within the pen reservoir that prevents flow of ink through the print head. The underpressure at the print head must be strong enough at all times for preventing ink leakage. However, the underpressure must not be so strong that the print head is unable to overcome the underpressure to jet ink drops, the size of the ink drops and the print quality are influenced, or the printing totally fails.

In order to maintain normal functions, the underpressure at the print head must be regulated within an operating range. In other words, the pressure in the ink reservoir must always be lower than the ambient pressure to prevent ink leakage, but not be too low to hinder the inkjet function. To fulfill the aforesaid requirements, many prior methods have been developed. For example, U.S. Pat. No. 4,992,802, "Method and apparatus for extending the environmental operating range of an ink jet print cartridge", disclosed by Dion et al, applies two pressure control mechanisms for limiting the reservoir underpressure. The first pressure control mechanism limits reservoir underpressure by introducing replacement fluid (i.e. air or ink) thereto. The second pressure control mechanism limits reservoir underpressure by changing the volume thereof. The two pressure control mechanisms cooperate to regulate the underpressure in the reservoir within a desired range. However, the mechanisms of Dion are rather complicated and occupy more space in the reservoir.

In contrast, a simpler mechanism, disclosed by Pollacek, et al in U.S. Pat. No. 5,040,002, "Regulator for ink-jet pens", provides a regulator that comprises a seat and associated valve element. The seat is mounted to the body of an inkjet pen reservoir. The seat has a port formed through it. Magnetism is employed to attract the seat and valve element together and thereby close the port and permit underpressure to develop in the reservoir. When the underpressure within the reservoir rises above the level that may cause failure of the inkjet print head, the valve element moves away from the seat to permit air to enter the reservoir, thereby reducing the underpressure to an operable level. However, the magnetic mechanism is influenced when a strong magnetic force is to close to the inkjet pen, for example, during transportation, the underpressure is changed and the function and quality of printing may be influenced.

Another kind of underpressure regulator includes a flexible bag mounted to a flat curved spring. The elasticity of the spring tends to contract the bag as the bag expands in response to back pressure reduction in the reservoir. As disclosed in U.S. Pat. No. 5,409,134, "Pressure-sensitive accumulator for ink-jet pens" by Cowger, et al, the flexible bag varies its volume between a minimum volume position and a maximum volume position to regulate the inkjet pen reservoir volume and adjust the underpressure so that the underpressure remains within an operating range that is suitable for preventing ink leakage while permitting the print head to continue ejecting ink drops. This kind of regulator, however, encounters the difficulty of exhausting the ink in the reservoir since the flexible bag has an expansion limitation. When the ink in the reservoir is low, the flexible bag has expanded to its limit, and the higher underpressure then causes the inkjet to fail and the rest of the ink cannot be used up. Furthermore, the ideal operative range of underpressure is within negative 2.5 to negative 10 cm water column, or −0.0024 to −0.0097 atmospheric pressure, which is so small that the elasticity of the spring has to be precisely controlled. The elasticity of the spring involves the technical problems of the contents of the material, the heat treatment process, and variations of shape, length and thickness of the spring, which cause instability of the spring characteristics. Consequently, Cowger, et al further discloses in U.S. Pat. No. 5,505,339, "Pressure-sensitive accumulator for ink-jet pens", some suitable shapes for the spring.

SUMMARY OF THE INVENTION

The primary object of the invention is to provide a reservoir mechanism for an inkjet pen like Pollacek's, but one that is simpler and is not influenced by external magnetic force.

The inkjet pen according to the invention includes an ink reservoir for storing ink and providing ink for jetting. The reservoir includes a rigid body for storing ink, a port located on top of the rigid body, fluid-communicated with the ambient air for adjusting the air pressure inside the ink reservoir, and a valve operated by a spring or a resilient element for normally sealing the port but occasionally opening the port to introduce air into the reservoir when the ink level is low and the underpressure rises. In another embodiment, an elastic bag is included in the reservoir and has an opening communicated with the ambient air through a second port formed on top of the reservoir. The elastic bag expands in response to the increasing underpressure generated in the reservoir when ink is being used. The bag expansion actuates the opening of the valve so as to regulate the underpressure.

BRIEF DESCRIPTION OF THE DRAWINGS

The invention will become more fully understood from the detailed description given hereinbelow. However, this description is for purposes of illustration only, and thus is not limitative of the invention, wherein.

DETAILED DESCRIPTION OF THE INVENTION

Figure 1:
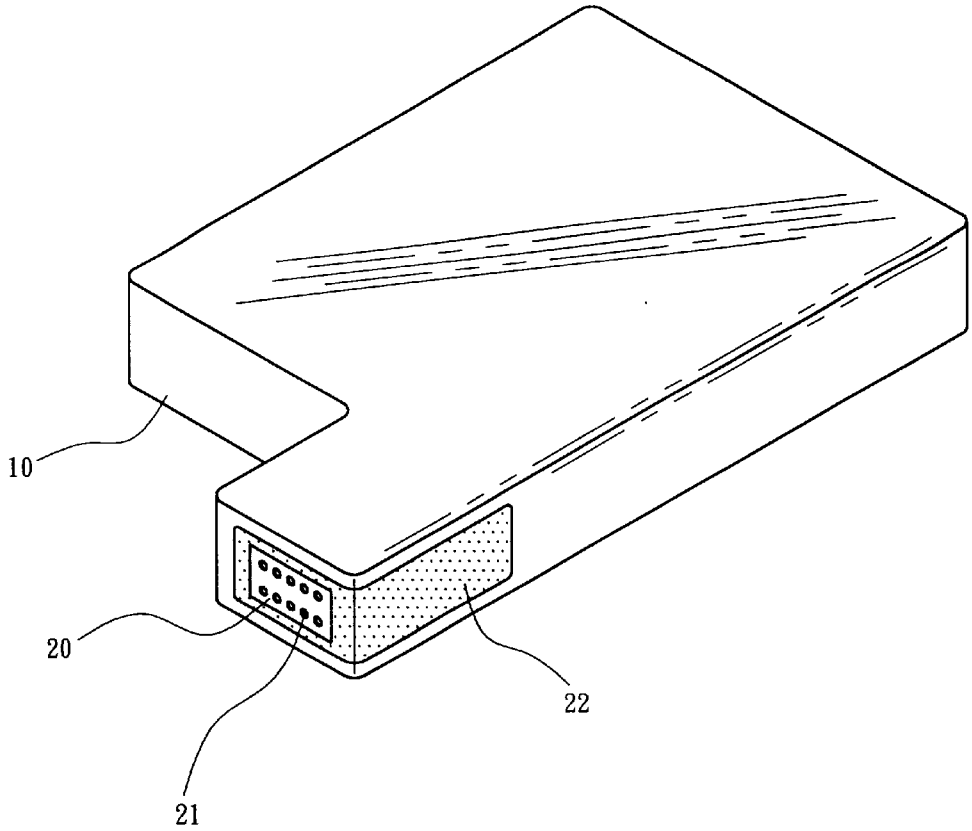
FIG. 1 is an explanatory configuration view of an inkjet pen of the invention, which is not scaled.

FIG. 1 shows a general configuration of an inkjet pen. The inkjet pen includes an ink reservoir 10 and a print head 20. The print head 20 is composed of several micro vents 21. A soft electrode band transfers control signals to the print head 20 so that ink drops are controlled to jet from the ink reservoir 10 to the paper (not shown in the drawing) or other objects.

The driving mechanisms for jetting ink drops are usually the thermal bubble system or the piezoelectric system. Whatever the system is, each micro vent 21 connects with an ink chamber where the driving mechanism functions.

First Embodiment

Figure 2:
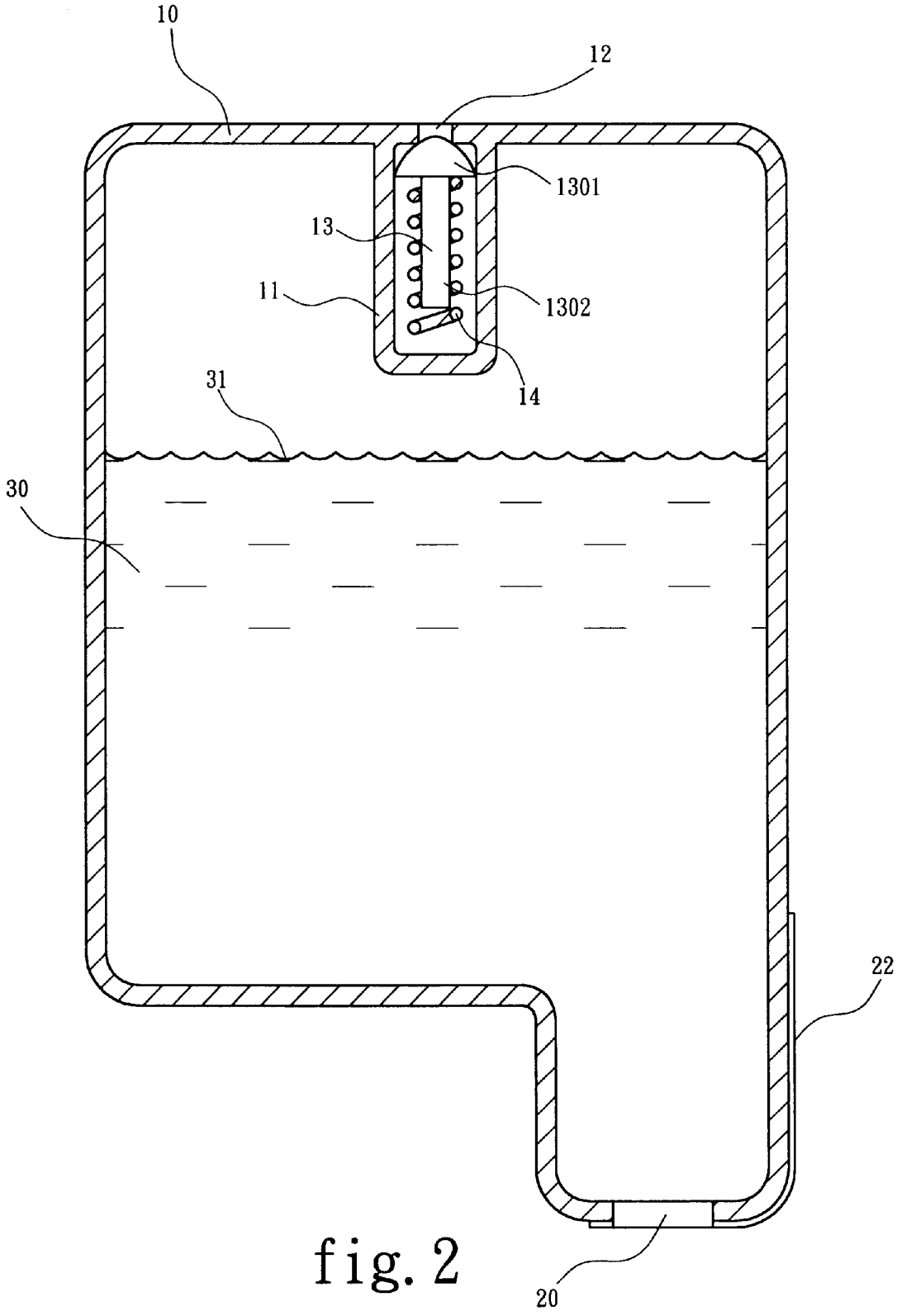
FIG. 2 is a sectional view of an inkjet pen of the first embodiment of the invention that does not include an air bag.

FIG. 2 is a first embodiment of an inkjet pen according to the invention. The inkjet pen 1 includes an ink reservoir 10 having a rigid body for storing ink and providing ink for jetting. A port 12 is formed on top of the rigid body, communicated with the ambient air, for adjusting the underpressure inside the ink reservoir 10. The port 12 is sealed from the inside of the reservoir 10 by a needle 13 that is pressed by a pressing spring 14 mounted in a seat 11. The needle 13 is formed with a cone or round end 1301 for tightly sealing the port 12. The stem 1302 of the needle 13 is sleeved in the spring 14 and has a flange 1303 touching the spring 14 so as to press and tightly seal the port 12 with the cone or round end 1301. However, any other shapes of the needle end 1301 can be used as long as the sealing can be achieved. As the ink is used, the underpressure in the cartridge increases, the needle 13 seals the port 12 till the force of the spring 14 cannot overcome the vacuum force of the underpressure, and a certain amount of ambient air will enter the cartridge 20 to decrease the underpressure to within operating range.

Second Embodiment

Figure 3:
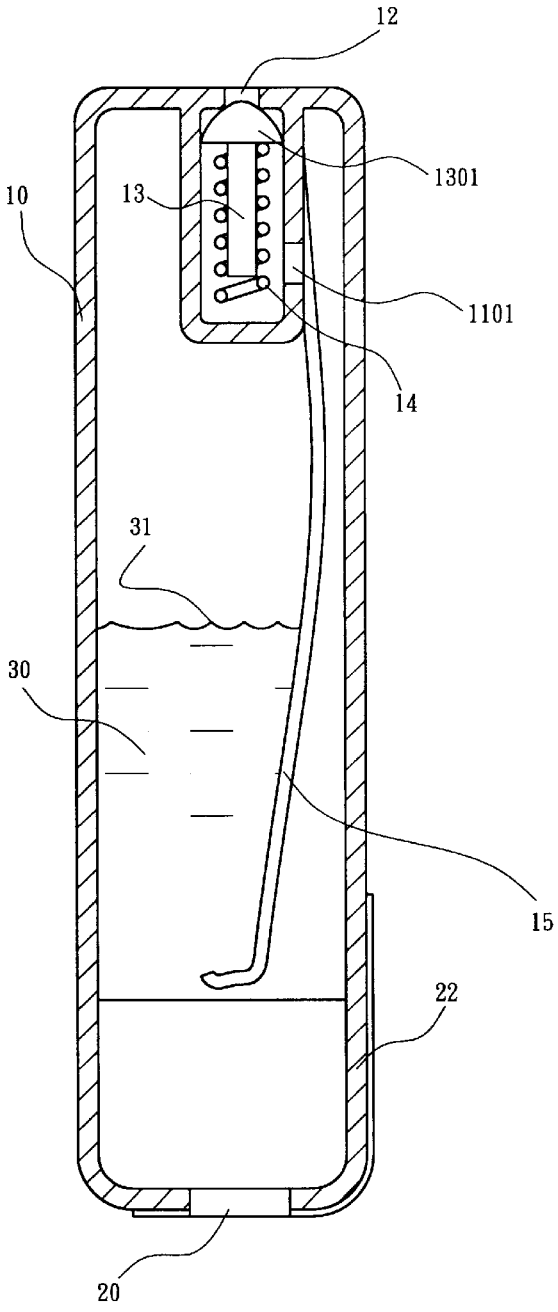
FIGS. 3 and 4 are sectional views of an inkjet pen of the second embodiment of the invention showing an air bag shrunk and expanded respectively.

FIG. 3 is a second embodiment of an inkjet pen according to the invention, which is a modification from the first embodiment of FIG. 2. An air bag 15 is fluid-communicated with the port 12 through a vent 1101 formed on the seat 11.

When the ink is being used, the level 31 of the ink decreases and the underpressure in the cartridge 10 increases. However, when the underpresuure is within the operating range, the pressing force provided by the spring 14 is larger than the pressure force of ambient air acting on the needle end 1301 so that the cartridge 10 remains sealed.

Figure 4:
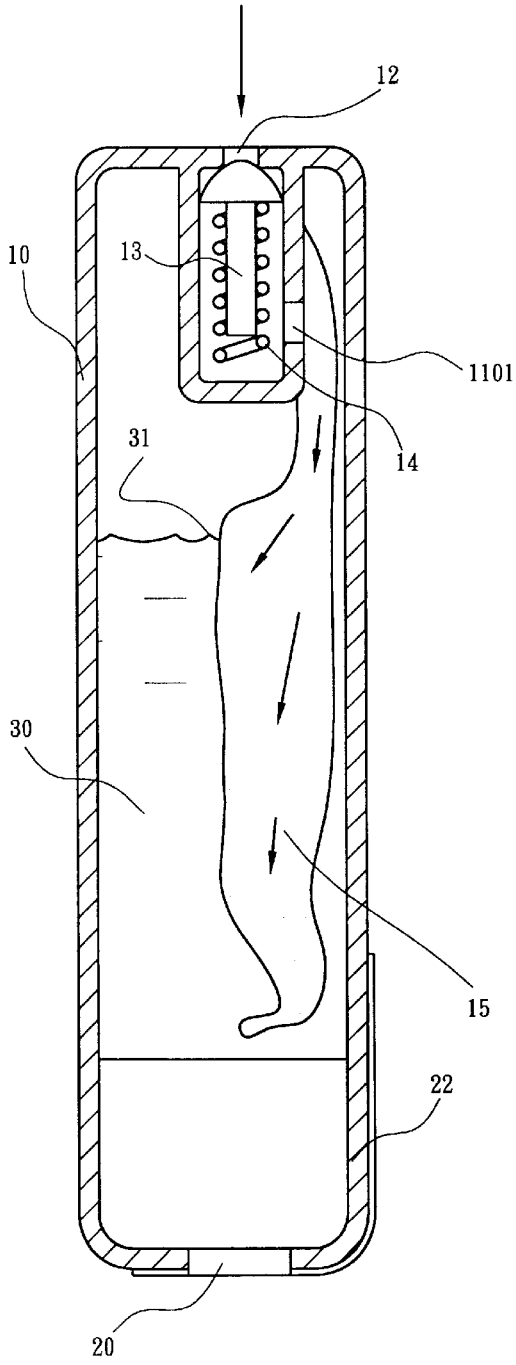

As shown in FIG. 4, after the underpressure reaches an upper limit, the pressure of the ambient air is greater than the pressing force of the spring 14 acting on the needle end 1301. Hence, the needle 13 is forced to retract and let ambient air flow into the cartridge 10 through the port 12. The input air blows up the air bag 15, which further pushes the ink level 31 up and lowers the underpressure to within operating range. After the underpressure decreases, the spring 14 presses the needle 13 back and seals the port 12 again.

Third Embodiment

Figure 5:
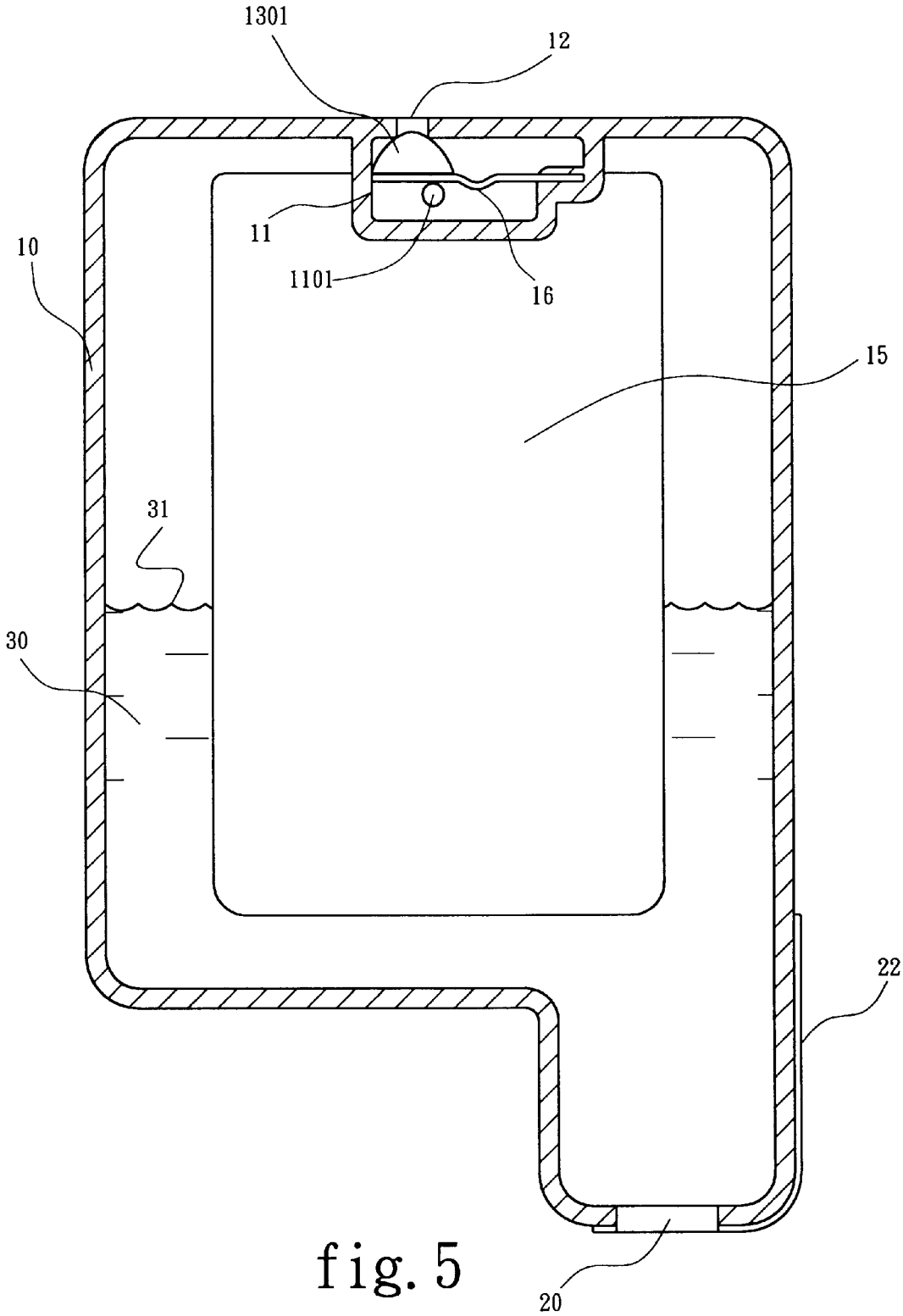
FIGS. 5 and 6 are sectional views of an inkjet pen of the third embodiment of the invention showing a port mechanism being sealed and opened respectively.

FIG. 5 is a third embodiment of an inkjet pen according to the invention, which is a modification from the second embodiment of FIG. 3. The needle 13 is now replaced with a spring plate 16 to force the cone-shaped sealing portion 1301 directly. The spring plate 16 forces the sealing portion 1301 to seal the port 12.

Figure 6:
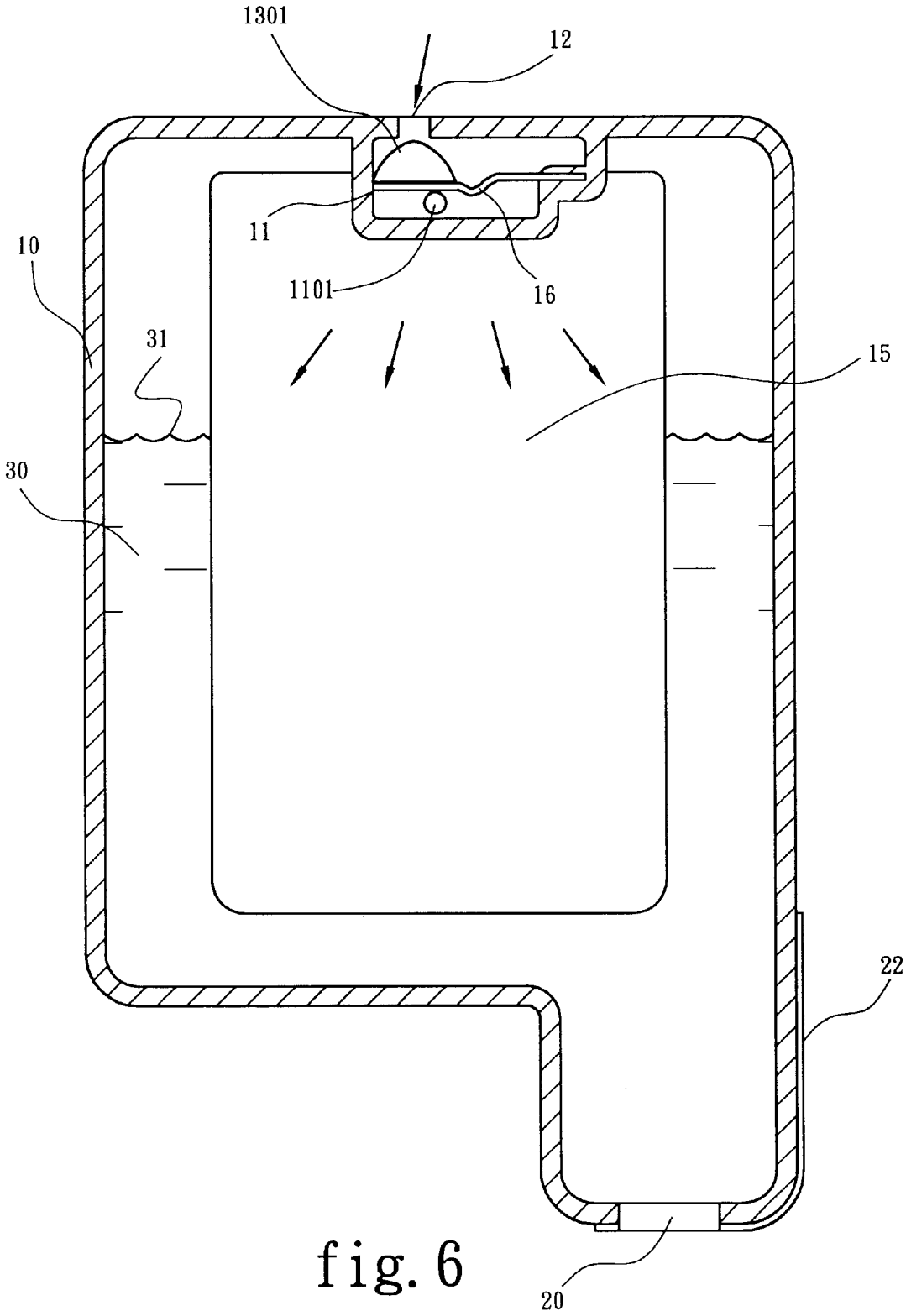

Same as the aforesaid functions, as shown in FIG. 6, when the ink is being used, the level 31 of the ink decreases and the underpressure in the cartridge 10 increases. After the underpressure reaches an upper limit, the pressure of the ambient air is greater than the pressing force of the spring plate 16 acting on the sealing portion 1301. Hence, the sealing portion 1301 is forced to retract and let ambient air flow into the cartridge 10 through the port 12. The input air blows up the air bag 15, which further pushes the ink level 31 up and lowers the underpressure to within operating range. After the underpressure decreases, the spring plate 16 further presses the sealing portion 1301 back and seals the port 12 again.

Fourth Embodiment

Figure 7:
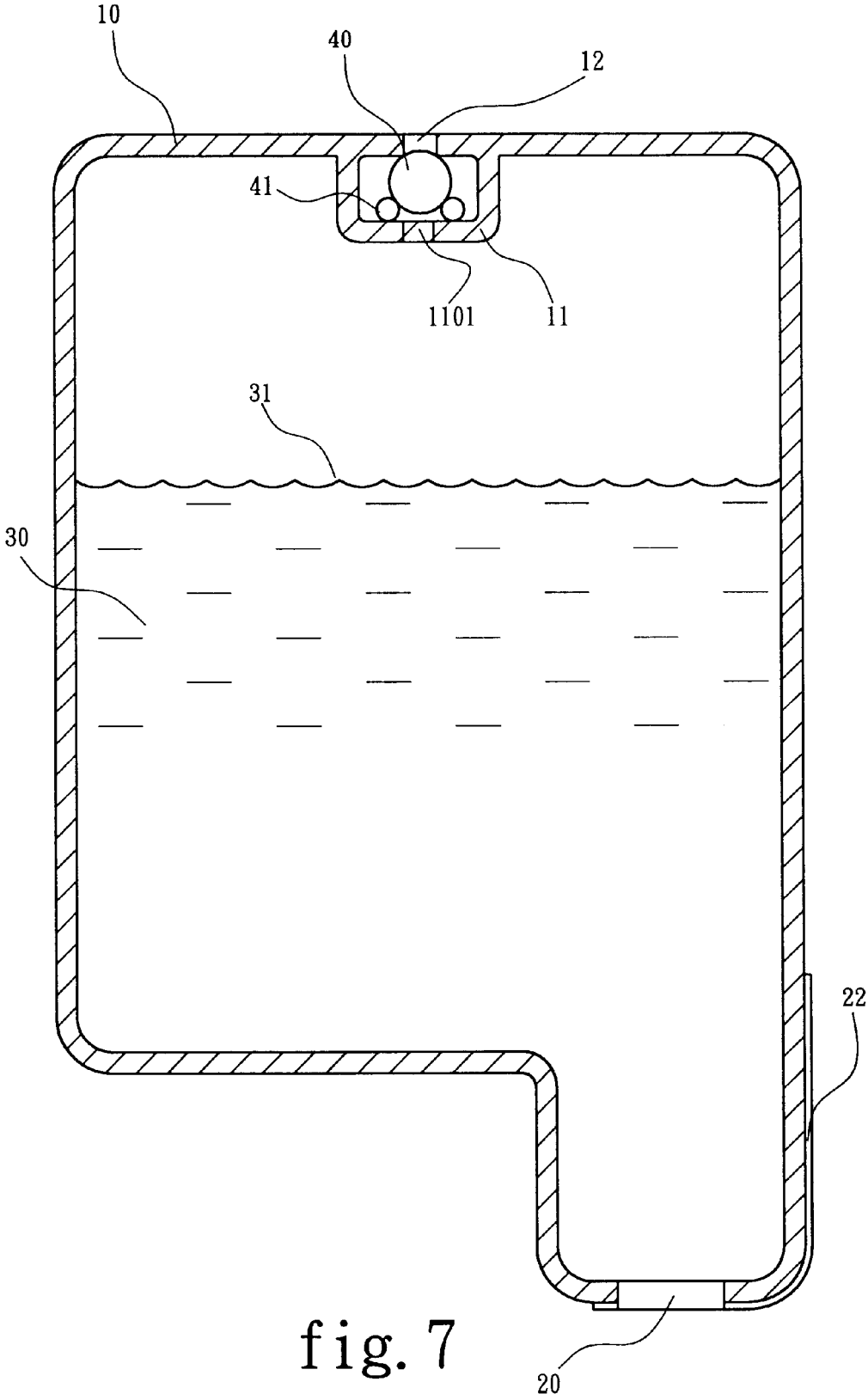
FIGS. 7 and 8 are sectional views of an inkjet pen of the fourth embodiment of the invention showing a port mechanism being sealed and opened respectively.

FIG. 7 is a fourth embodiment of an inkjet pen according to the invention, which is a modification from the first embodiment of FIG. 2. The needle is replaced with a spheric element, such as a steel ball 40, and the spring is replaced with a resilient element, such as an O-ring 41.

Figure 8:
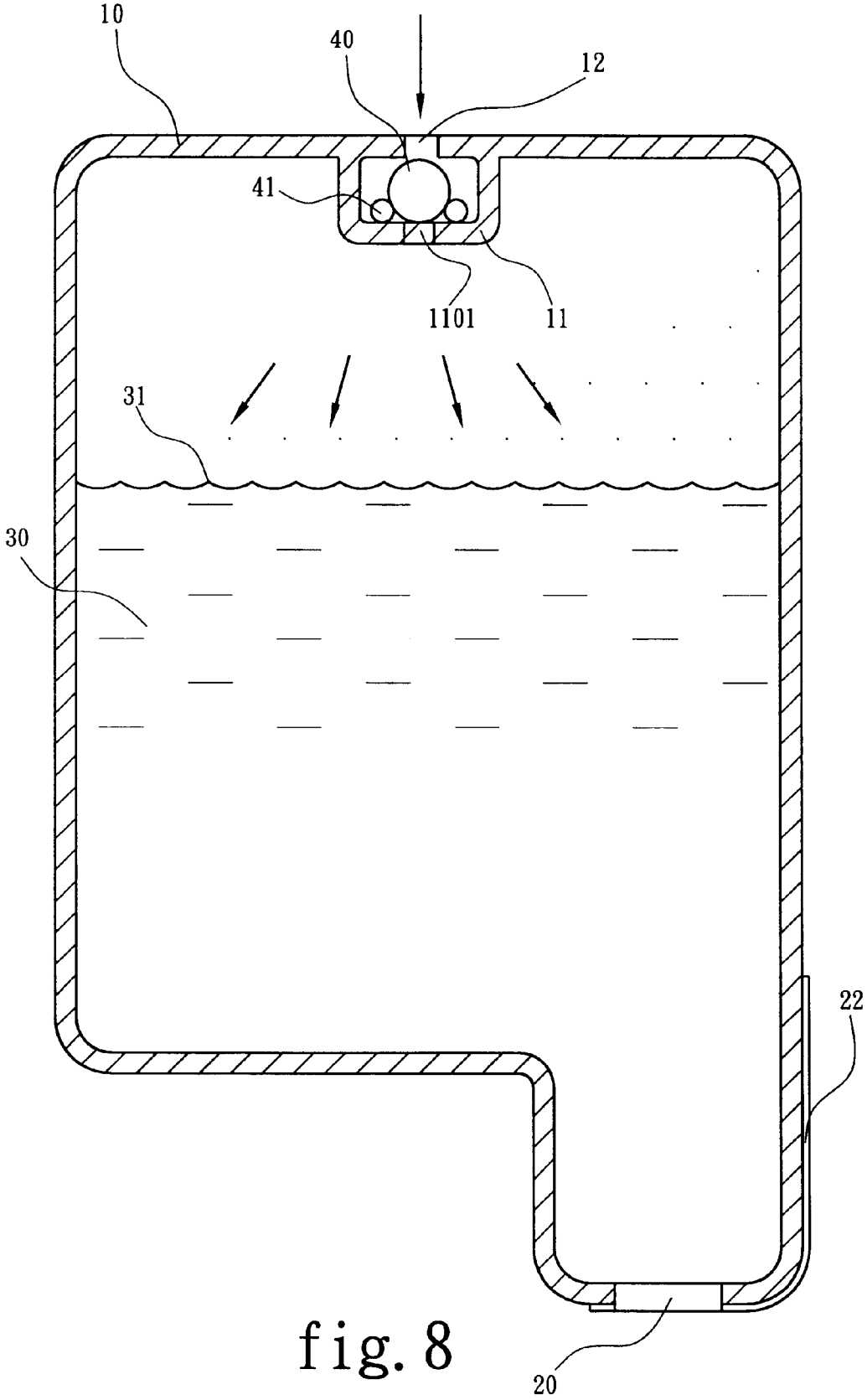

Same as the aforesaid functions, as shown in FIG. 8, when the ink is being used, the level 31 of the ink decreases and the underpressure in the cartridge 10 increases. After the underpressure reaches an upper limit, the pressure of the ambient air is greater than the pressing force of the resilient element 41 acting on the spheric element 40. Hence, the spheric element 40 is forced to retract and let ambient air flow into the cartridge 10 through the port 12. After the underpressure decreases, the resilient element 41 further presses the spheric element 40 back and seals the port 12 again.

In order to prevent the ink from leaking during idle time, the underpressure in the cartridge has to be higher than −2.5 cm water column but not higher than −10 cm water column. Therefore, in the aforesaid embodiments, the pressing force of the resilient element (the spring 14, spring plate 16 or O-ring 41) to the sealing element (the needle end 1301 or spheric element 40) is set to balance with the force of ambient air on the sealing element when the underpressure in the cartridge is about −10 cm water column. Thus, when the underpressure in the cartridge approaches −10 cm water column, the ambient air pushes the sealing element to open the port 12 and enters the cartridge to decrease the underpressure. Finally, before the underpressure decreases to −2.5 cm water column, the pressing force of the resilient element presses the sealing element to seal the port 12 so as to maintain a minimum underpressure for avoiding ink leakage.

Fifth Embodiment

Figure 10:
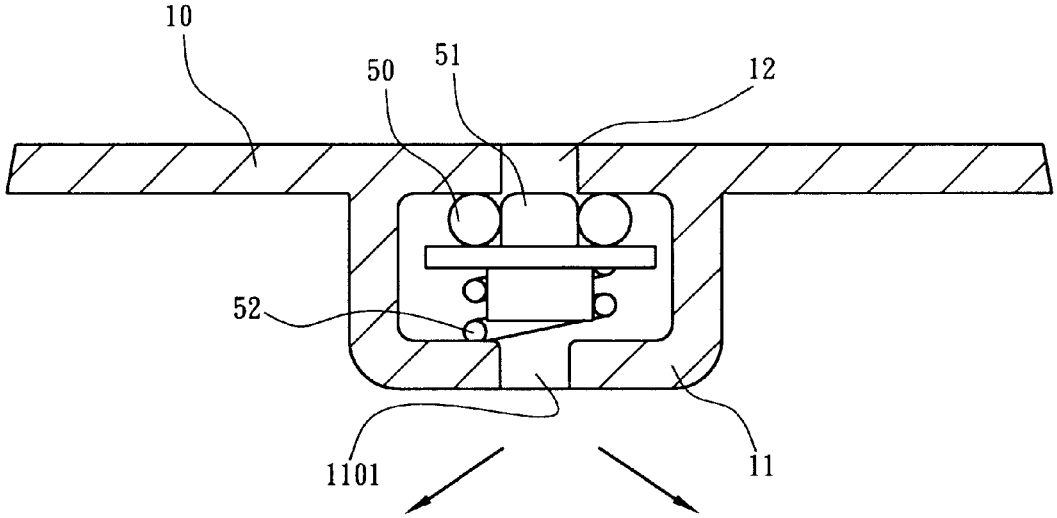
FIG. 10 is a partial sectional view of port mechanism of an inkjet pen of the fifth embodiment of the invention.

FIG. 10 is a fifth embodiment of an inkjet pen according to the invention showing the port mechanism only. A movable element 51 carrying an O-ring 50 is movably mounted in a seat 11 and forced by a spring 52 to seal the port 12 of the cartridge 10. When the ink in the cartridge 10 is being used, the underpressure in the cartridge 10 increases. After the underpressure reaches an upper limit, the pressure of the ambient air is greater than the pressing force of the spring 52 acting on the movable element 51. Hence the movable element 51 with the O-ring 50 is forced to retract and let ambient air flow into the cartridge 10 through the port 12. After the underpressure decreases, the spring 52 further presses the movable element 51 back and the O-ring seals the port 12 again.

Figure 9:
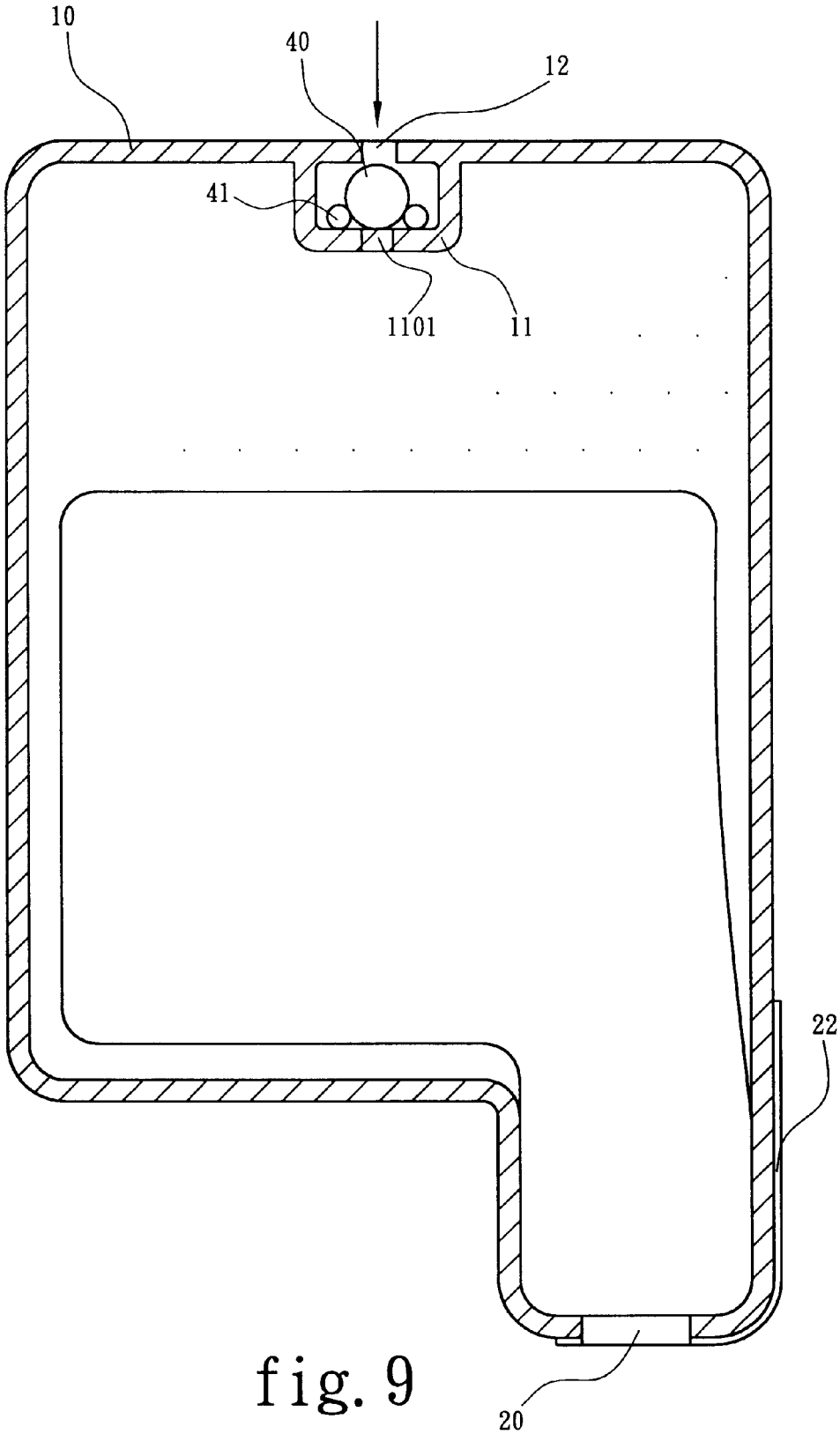
FIG. 9 is an example of an inkjet pen based on the fourth embodiment of the invention incorporating an ink bag.

In each of the aforesaid embodiments, an ink bag 60 can be used in the cartridge 10 in order to prevent air from coming in contact with the ink. Taking the fourth embodiment for example, the ink bag incorporated therein is shown in FIG. 9. When the ink is used for printing, the ink bag 60 gradually shrinks, and the air cavity in the cartridge 10 is gradually increased. As a result, the underpressure continues to increase. When the underpressure reaches an upper limit, the pressure of the ambient air overcomes the pressing force of the resilient element 41 acting on the spheric element 40. Therefore, the spheric element 40 is retracted to let some ambient air flow into the cartridge 10 through the port 12. As the air enters, the underpressure in the cartridge decreases to within operating range, and the resilient element 41 further presses the spheric element 40 to seal the port 12.

Sixth Embodiment

Figure 11:
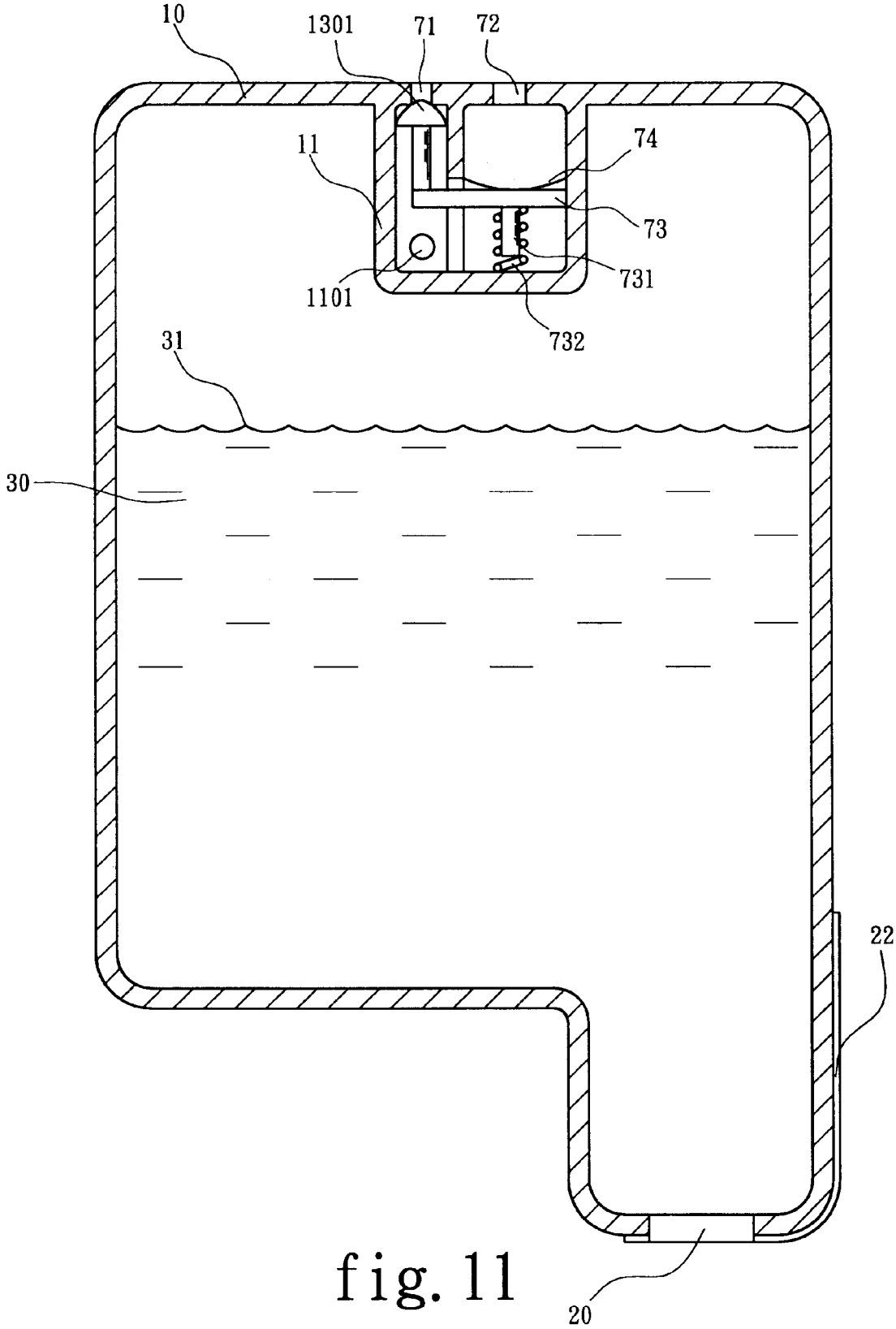
FIG. 11 is a sectional view of an inkjet pen of the sixth embodiment of the invention showing the components in positions of normal underpressure within the operating range.

FIG. 11 is a sixth embodiment of an inkjet pen according to the invention. The port mechanism includes a first port 71 and a second port 72. The first port 71 is selectively sealed and opened by a needle 13, which is connected to a connecting element 73 mounted in a seat 11. The connecting element 73 is forced by a pressing spring 732 sleeved in a stem 731 so as to press the needle 13 sealing the first port 71 with the needle end 1301. The second port 72 is fluid-communicated with a resilient air bag 74 in a manner such that when the ambient air pressure is higher than the air pressure inside the cartridge 10, the air bag 74 expands. As the air bag 74 expands and touches the connecting member 73, it starts to overcome the pressing force of the spring 732, and eventually moves the connecting element 73 and the needle 13 down to open the first port 71. As shown in FIG. 11, when the ink 30 is being used, the level 31 of the ink 30 in the cartridge 10 decreases and the underpressure in the cartridge 10 increases. However, when the underpresuure is within operating range, the pressing force provided by the spring 732 is larger than the composite force of the ambient air pressure acting on the needle end 1301 and the expansion force of the air bag 74 acting on the connecting member 73 so that the first port 71 remains sealed.

Figure 12:
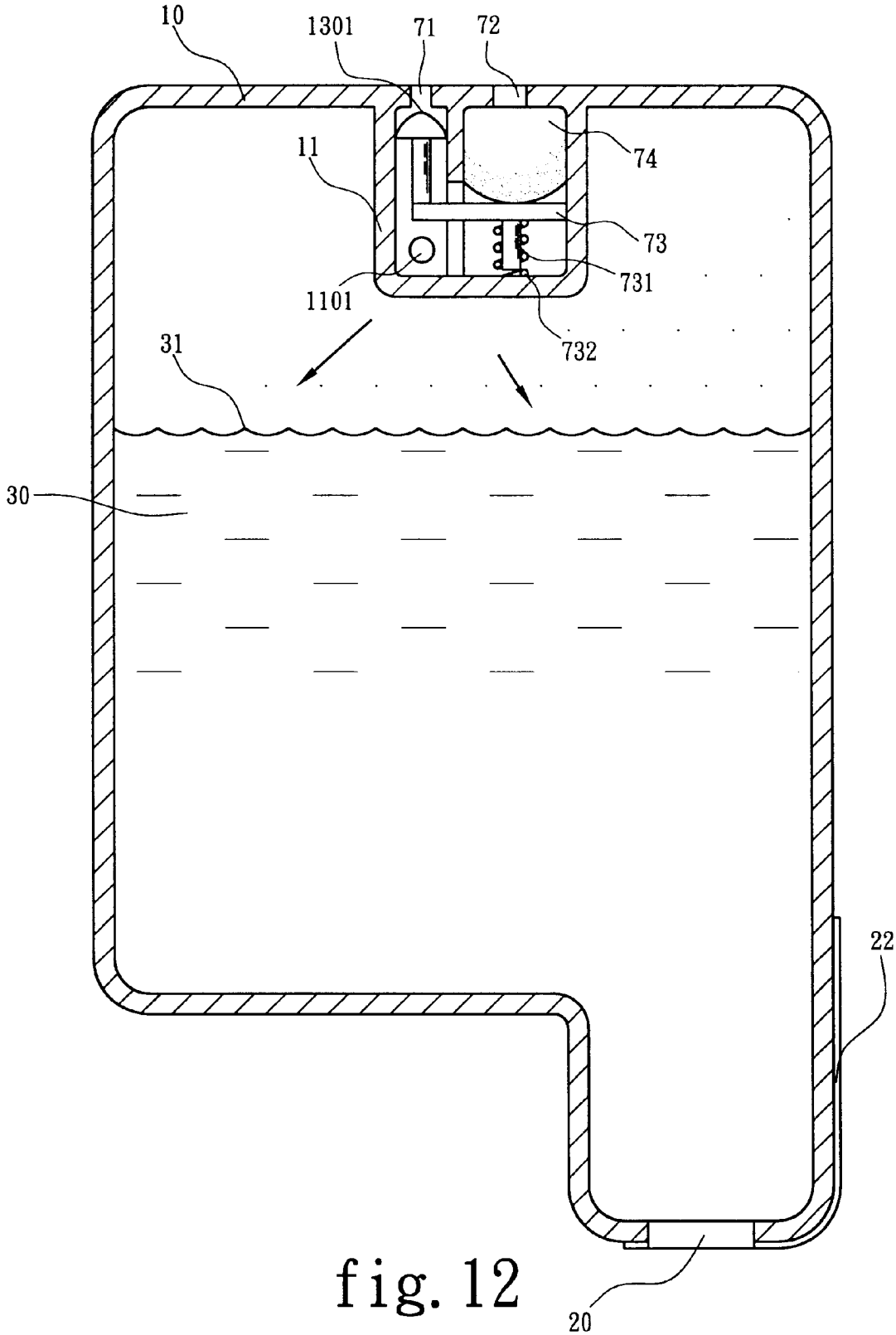
FIG. 12 is a sectional view of an inkjet pen of the sixth embodiment of the invention showing the components in positions of higher underpressure outside the operating range.

As shown in FIG. 12, after the underpressure reaches an upper limit, the composite force of the ambient air pressure acting on the needle end 1301 and the expansion force of the air bag 74 acting on the connecting member 73 is greater than the pressing force of the spring 732 acting on the connecting member 73 and the needle 13. Hence, the needle 13 is forced to retract and let ambient air flow into the cartridge 10 through the port 71 and a vent 1101. The input air lowers the underpressure. After the underpressure decreases to within operating range, the spring 732 further presses the connecting member 73 and the needle 13 back and seals the port 71 again.

Seventh Embodiment

Figure 13:
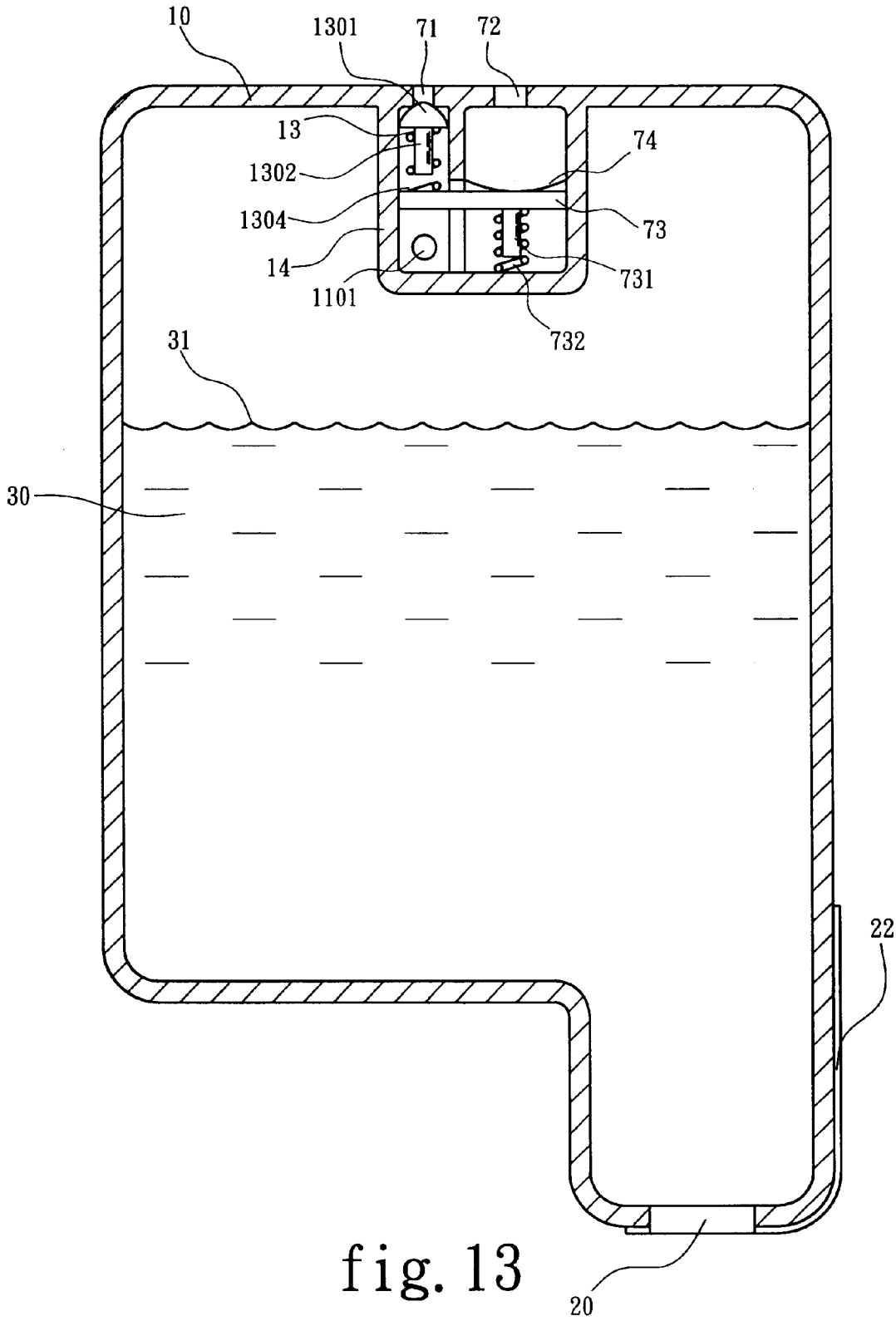
FIG. 13 is a sectional view of an inkjet pen of the seventh embodiment of the invention showing the components in positions of normal underpressure within the operating range.
Figure 14:
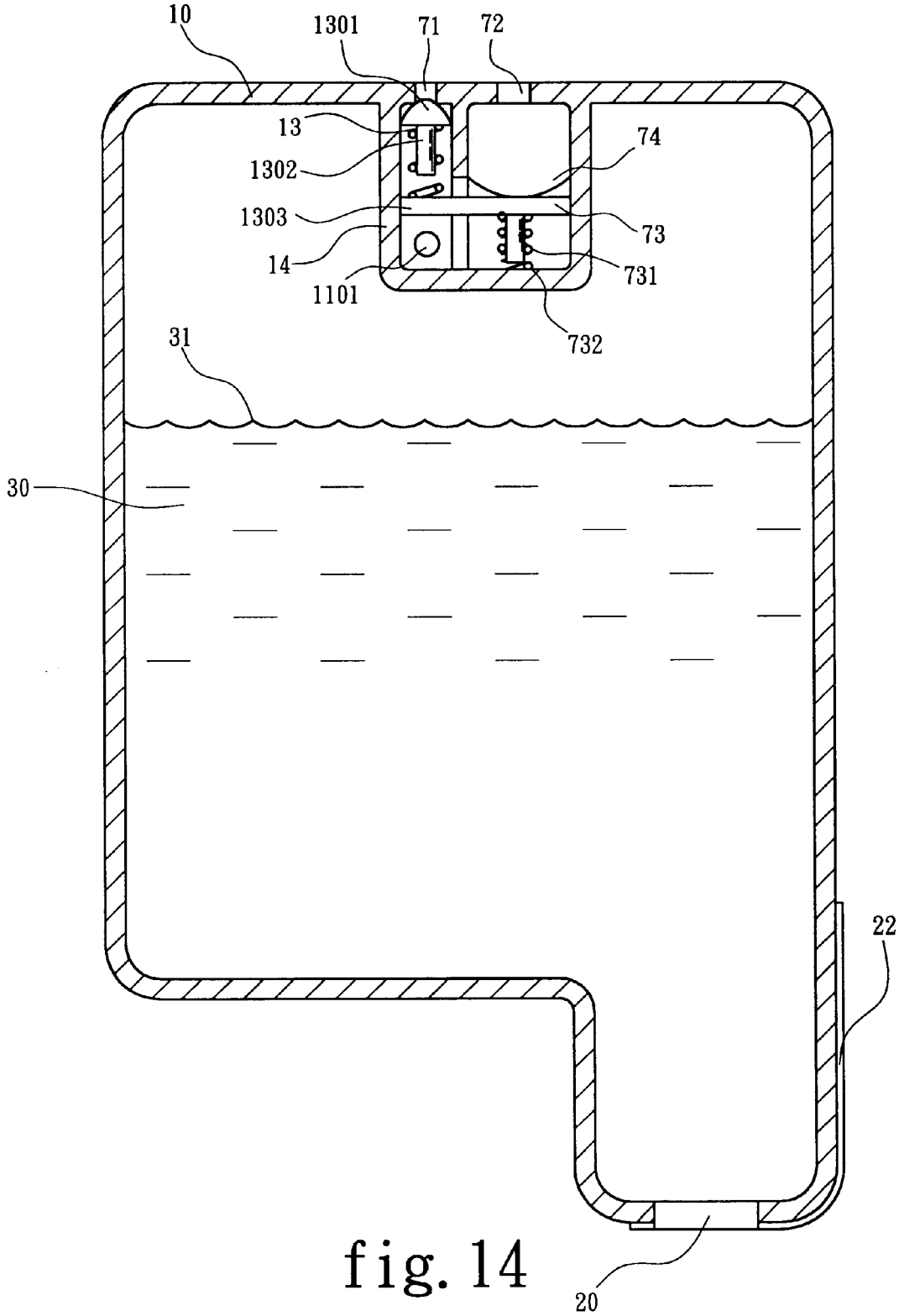
FIG. 14 is a sectional view of an inkjet pen of the seventh embodiment of the invention showing the components in positions of higher underpressure outside the operating range.

FIG. 13 is a seventh embodiment of an inkjet pen according to the invention, which is a modification from the sixth embodiment of FIG. 11. Instead of directly connecting the needle 13 with the connecting member 73, the needle 13 is now flexibly connected to the connecting element 73 through a pressing spring 1304 in order to enhance the sensitivity of movement. The pressing spring 1304 provides a certain force to seal the needle 13 to the port 71. As shown in FIG. 14, when the ink 30 is being used, the level 31 of the ink in the cartridge 10 decreases and the underpressure in the cartridge 10 increases. However, when the underpresuure is within operating range, the pressing force provided by the springs 732 and 1304 is greater than the composite force of the ambient air pressure acting on the needle end 1301 and the expansion force of the air bag 74 acting on the connecting member 73 so that the first port 71 remains sealed.

Figure 15:
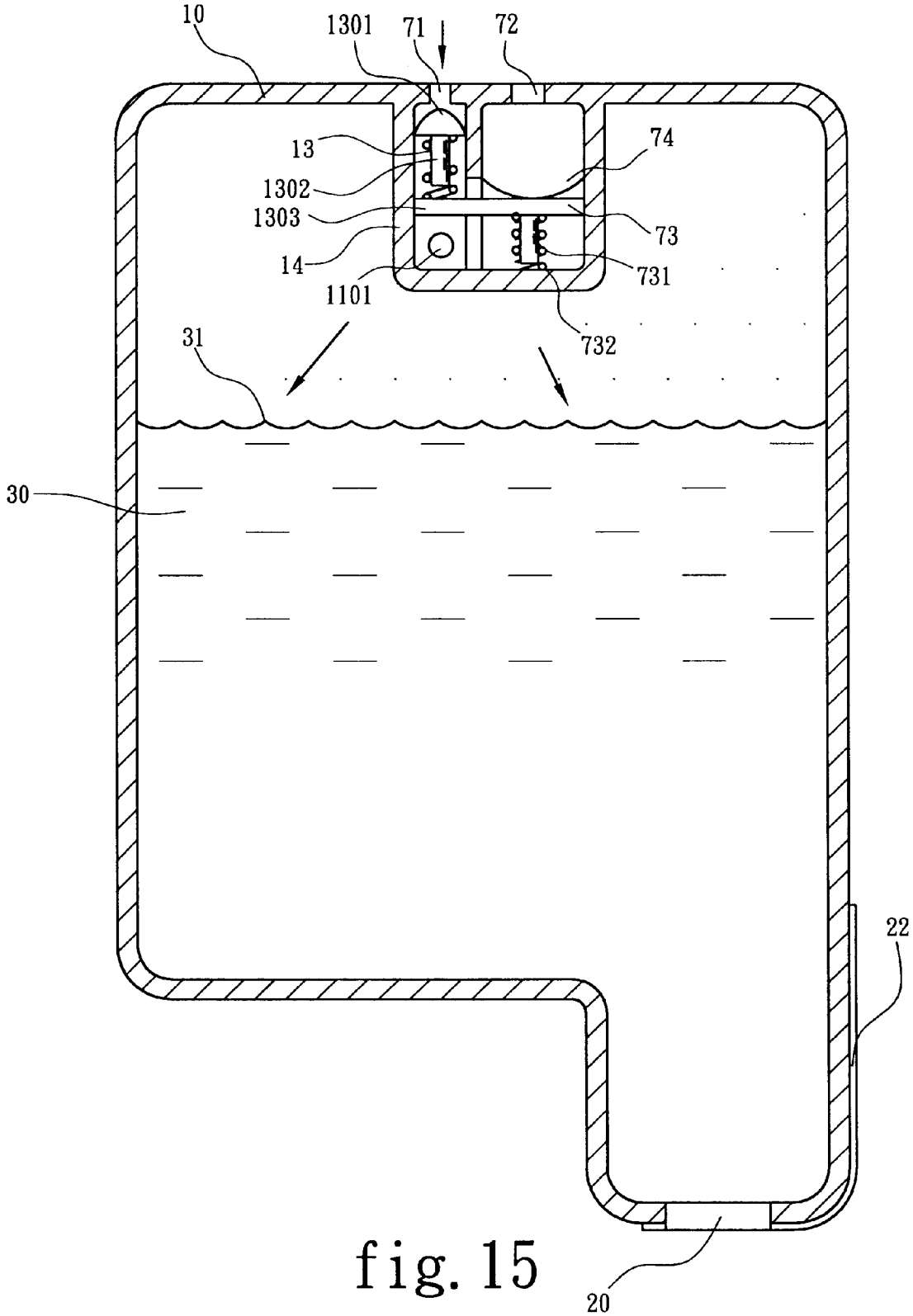
FIG. 15 is an operational view of an inkjet pen of the seventh embodiment of the invention showing the ambient air entering the inkjet pen when there is higher underpressure.

As shown in FIG. 15, after the underpressure reaches an upper limit, the composite force of the ambient air pressure acting on the needle end 1301 and the expansion force of the air bag 74 acting on the connecting member 73 is greater than the composite force of the pressing force of the spring 732 acting on the connecting member 73 and the pressing force of the spring 1304 acting on the needle 13. Hence, the needle 13 is forced to retract and let ambient air flow into the cartridge 10 through the port 71 and a vent 1101. The input air lowers the underpressure. After the underpressure decreases to within operating range, the springs 732 and 1304 further press the connecting member 73 and the needle 13 back and seal the port 71 again.

Eighth Embodiment

Figure 16:
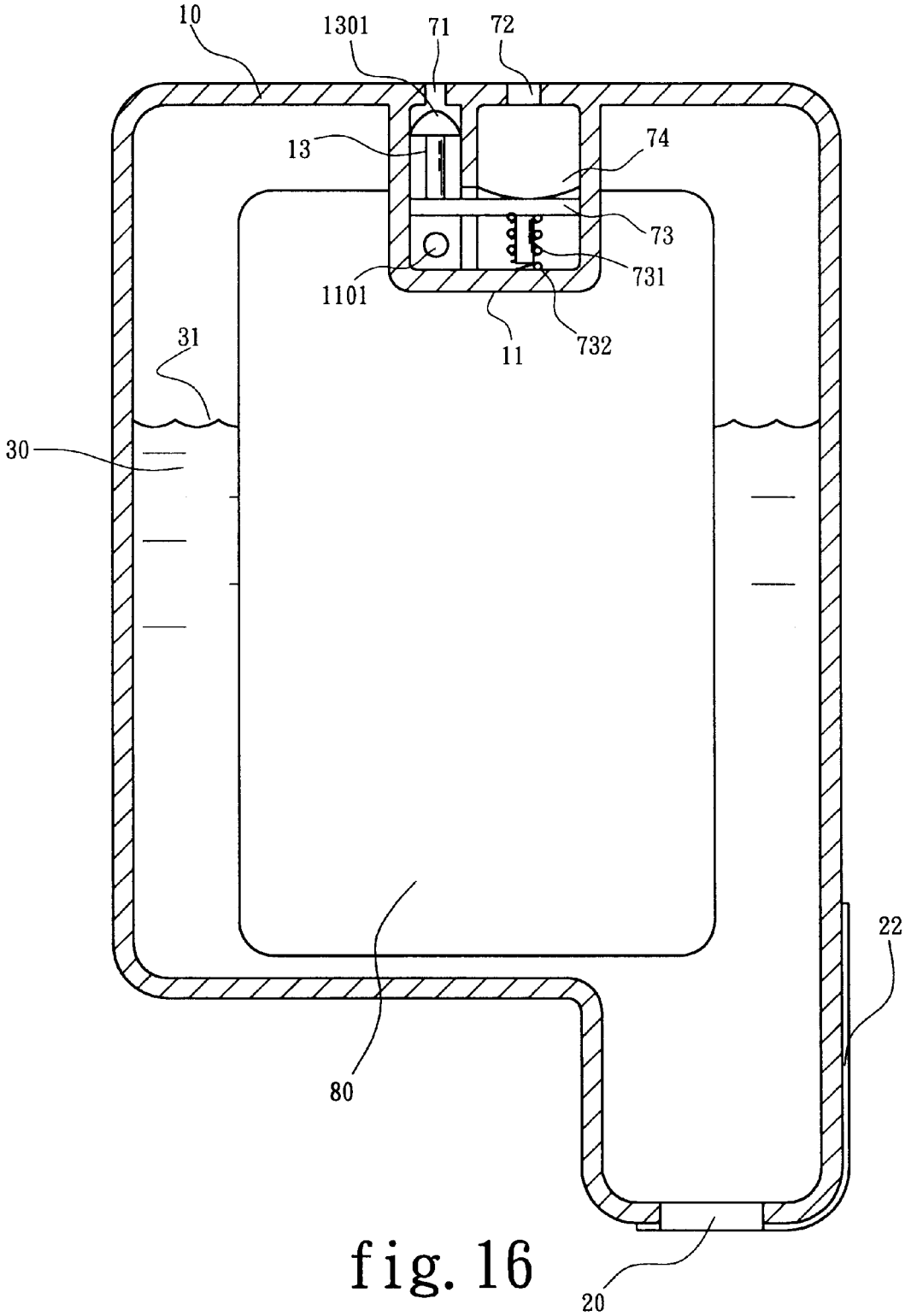
FIG. 16 is a sectional view of an inkjet pen of the eighth embodiment based on the sixth embodiment of the invention incorporating an air bag.
Figure 17:
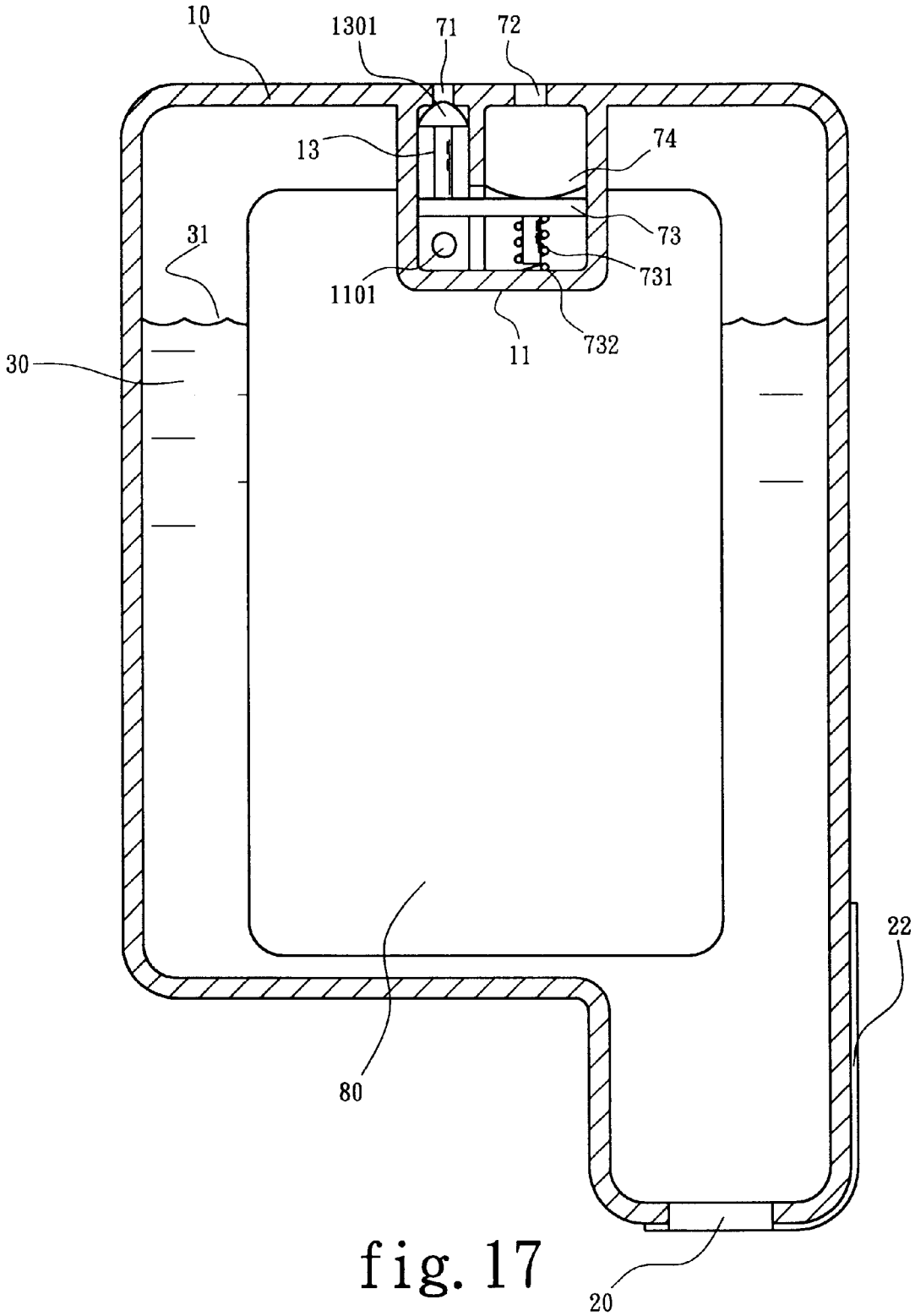
FIG. 17 is an operational view of an inkjet pen of the eighth embodiment of the invention showing the ambient air entering the air bag and decreasing the underpressure.

FIG. 16 is an embodiment of the invention that further includes a resilient air bag 80 as that of the sixth embodiment in order to prevent ambient air from coming in contact with the ink 30. As shown in FIG. 17, when the ink 30 is being used, the level 31 of the ink in the cartridge 10 decreases and the underpressure in the cartridge 10 increases. After the underpressure reaches an upper limit, the composite force of the ambient air pressure acting on the needle end 1301 and the expansion force of the air bag 80 acting on the connecting member 73 is greater than the pressing force of the spring 732 acting on the connecting member 73 and the needle 13. Hence, the needle 13 is forced to retract and let ambient air flow into the air bag 80 through the port 71 and a vent 1101. The input air blows up the air bag 80, which further pushes the ink level 31 up and lowers the underpressure to within operating range.

Ninth Embodiment

Figure 18:
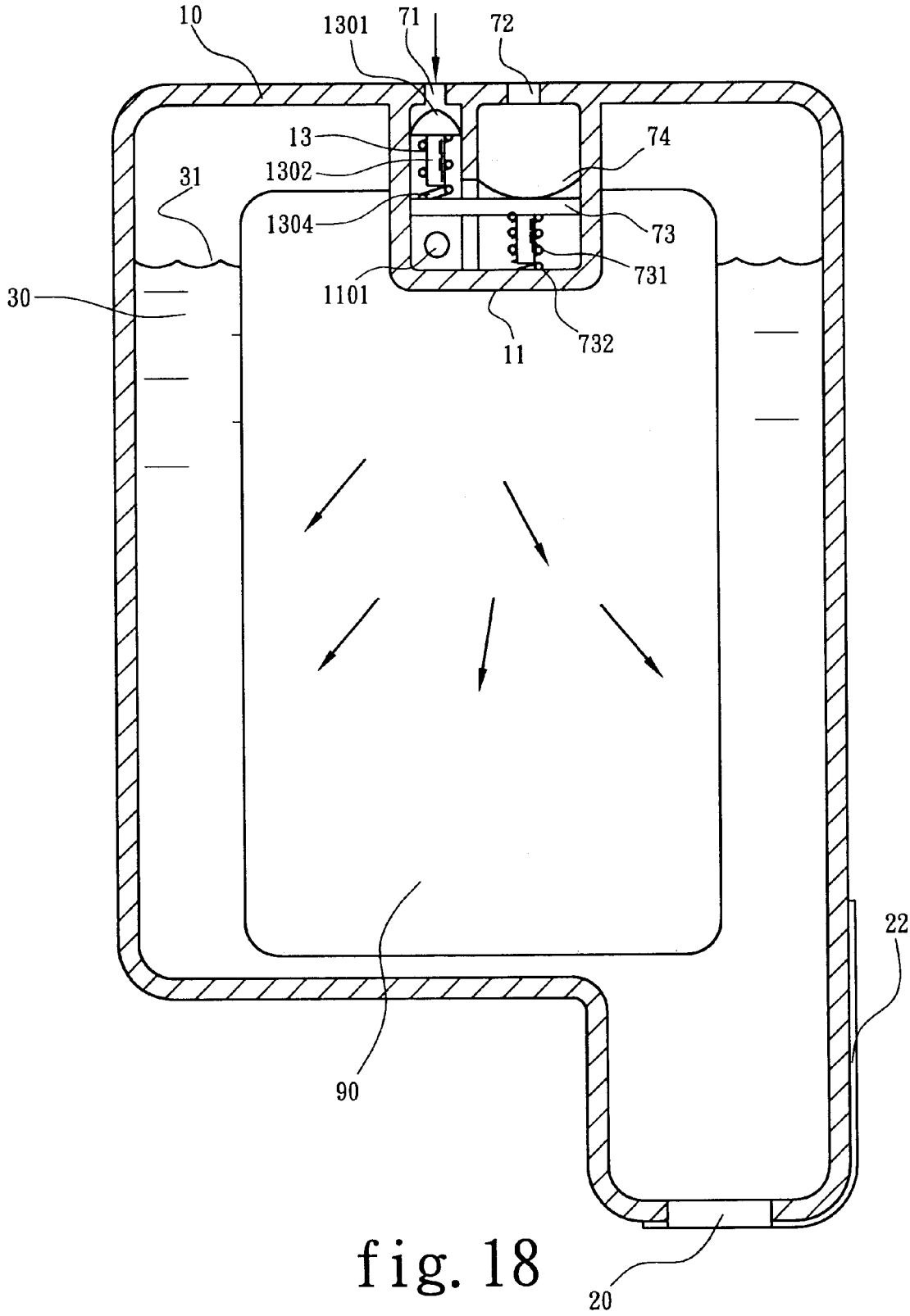
FIG. 18 is a sectional and operational view of an inkjet pen of the ninth embodiment based on the seventh embodiment of the invention and incorporating an air bag, in which the ambient air is entering the air bag and decreasing the underpressure.

FIG. 18 is an embodiment of the invention that further includes a resilient air bag 90 from the seventh embodiment in order to prevent ambient air from coming in contact with the ink 30. When the ink 30 is being used, the level 31 of the ink in the cartridge 10 decreases and the underpressure in the cartridge 10 increases. After the underpressure reaches an upper limit, the composite force of the ambient air pressure acting on the needle end 1301 and the expansion force of the air bag 90 acting on the connecting member 73 is greater than the pressing force of the spring 732 acting on the connecting member 73 and the needle 13. Hence, the needle 13 is forced to retract and let ambient air flow into the air bag 90 through the port 71 and a vent 1101. The input air blows up the air bag 90, which further pushes the ink level 31 up and lowers the underpressure to within operating range.

While the invention has been described in its preferred embodiments, it is to be understood that the words which have been used are words of description rather than limitation and that changes within the purview of the appended claims may be made without departing from the true scope and spirit of the invention.

What is claimed is:

1. A device, applicable to an inkjet pen composed of a print head and an ink cartridge having a port formed thereon, said port is fluid-communicated with ambient air, for regulating underpressure in said cartridge and prevent ink from leakage, comprising:

a seat, formed adjacent to said port, having a vent fluid-communicated with said port and interior of said cartridge;

a valve element, movably mounted in said seat, for selectively sealing and opening said port; and a resilient element, mounted in said seat and connected with said valve element, for normally moving said valve element to seal said port.

2. A device for regulating underpressure inside a cartridge of an inkjet pen according to claim 1 wherein said valve is a needle having a stem and a head portion chosen from one of cone and round shapes.

3. A device for regulating underpressure inside a cartridge of an inkjet pen according to claim 2 wherein said portion of said needle comprises a flange connected to said stem.

4. A device for regulating underpressure inside a cartridge of an inkjet pen according to claim 2 wherein said resilient element is a pressing spring sleeved in said stem and pressing said head portion of said needle to seal said port.

5. A device for regulating underpressure inside a cartridge of an inkjet pen according to claim 1 wherein said resilient element is a spring plate having one end pressing said valve element to seal said port.

6. A device for regulating underpressure inside a cartridge of an inkjet pen according to claim 5 wherein said resilient element having one end connected to said seat.

7. A device for regulating underpressure inside a cartridge of an inkjet pen according to claim 5 wherein said resilient element having one end connected to said cartridge of an inkjet pen.

8. A device for regulating underpressure inside a cartridge of an inkjet pen according to claim 1 wherein said resilient element is an O-ring; said valve element is a spheric element to be forced by said O-ring for sealing said port.

9. A device for regulating underpressure inside a cartridge of an inkjet pen according to claim 1 wherein said valve element comprises:

an airtight ring mounted in said seat and surrounding said port; and a movable element for mounting said airtight ring and being pressed by said resilient element to seal said port with said airtight ring.

10. A device for regulating underpressure inside a cartridge of an inkjet pen according to claim 1 wherein said valve element pressed by said resilient element is capable of overcoming ambient air pressure acting on said valve element and sealing said port in a range of underpressure within negative 2.5 to negative 10 cm water column.

11. A device for regulating underpressure inside a cartridge of an inkjet pen according to claim 1 further comprises an expandable air bag mounted inside said cartridge and fluid-communicated with said vent of said seat.

12. A device for regulating underpressure inside a cartridge of an inkjet pen according to claim 1 further comprises an ink bag mounted inside said cartridge and fluid-communicated with said print head.

13. A device, applicable to an inkjet pen composed of a print head and an ink cartridge having a first and a second ports formed thereon, fluid-communicated with ambient air, for regulating underpressure in said cartridge and prevent ink from leakage, comprising:

a seat, formed adjacent to said first port, having a vent fluid-communicated with said first port and interior of said cartridge;

an expandable air bag, fluid-communicated with said second port, for being expanded by ambient air when said underpressure in said cartridge increases, and moving a connecting element thereby;

a resilient element, connecting to said connecting element, for providing a pressing force to bias said connecting element against expansion direction of said air bag; and a valve element, movably mounted in said seat, for selectively sealing and opening said port corresponding to said pressing force of said resilient element and said expansion of said air bag.

14. A device for regulating underpressure inside a cartridge of an inkjet pen according to claim 13 wherein said valve is a needle having a stem and a head portion chosen from one of cone and round shapes.

15. A device for regulating underpressure inside a cartridge of an inkjet pen according to claim 14 wherein a lower end of said needle is connected with said connecting element; said resilient element provides force to press said connecting element and said needle to seal said port.

16. A device for regulating underpressure inside a cartridge of an inkjet pen according to claim 14 wherein said needle and said connecting element are connected through a pressing spring sleeved in said stem.

17. A device for regulating underpressure inside a cartridge of an inkjet pen according to claim 14 wherein said force for sealing said valve element to said port is counter to composite force of ambient air pressure force acting on head portion of said needle and expansion force of said expandable air bag, and balanced at underpressure of negative 2.5 to negative 10 cm water column.

18. A device for regulating underpressure inside a cartridge of an inkjet pen according to claim 13 wherein said resilient element is a pressing spring having one end connected to said connecting element, and another end contacted with said seat in a pressed condition so as to provide pressing force to said connecting element.

19. A device for regulating underpressure inside a cartridge of an inkjet pen according to claim 18 wherein said connecting element comprises a stem for holding said pressing spring in a suitable position.

20. A device for regulating underpressure inside a cartridge of an inkjet pen according to claim 13 further comprises an air bag fluid-communicated with said vent of said seat and capable of fluid-communication with ambient air through said first port.

* * * * *

UNITED STATES PATENT AND TRADEMARK OFFICE

CERTIFICATE OF CORRECTION

PATENT NO. : 6,719,418 B2
DATED : April 13, 2004
INVENTOR(S) : Chou, Ching-Yu et al.

It is certified that error appears in the above-identified patent and that said Letters Patent is hereby corrected as shown below:

Title page,
Item [73], Assignee, change "Nanodynamics Inc." to -- NanoDynamics Inc. --.

Signed and Sealed this

Twenty-first Day of December, 2004

JON W. DUDAS
*Director of the United States Patent and Trademark Office*